United States Patent [19]

Iknadossian

[11] Patent Number: 4,702,856

[45] Date of Patent: Oct. 27, 1987

[54] ORGANIC CAR WASH CONTAINING RAW POTATO JUICE

[76] Inventor: Leon Iknadossian, P.O. Box 2022, City of Industry, Calif. 91746

[21] Appl. No.: 2,507

[22] Filed: Jan. 12, 1987

[51] Int. Cl.[4] ..... C11D 1/04; C11D 3/43; C11D 3/382; C11D 17/08

[52] U.S. Cl. ..... 252/170; 252/89.1; 252/132; 252/173; 252/174.17; 252/174.21; 252/DIG. 1; 252/DIG. 10; 252/DIG. 14

[58] Field of Search ..... 252/132, 89.1, 174.21, 252/173, 174.17, 367, 368, 369, DIG. 10, DIG. 14, 162, 170, DIG. 1

[56] References Cited

U.S. PATENT DOCUMENTS

| | | | |
|---|---|---|---|
| 58,919 | 10/1866 | Spanckeren | 252/132 |
| 59,724 | 11/1866 | Milne | 252/130 |
| 1,823,192 | 9/1931 | English | 252/173 |
| 2,049,476 | 8/1936 | Sodergreen | 87/16 |
| 4,162,983 | 7/1979 | Johnson | 252/8.6 |
| 4,237,016 | 12/1980 | Rudkin et al. | 252/8.8 |
| 4,483,782 | 11/1984 | Cox et al. | 252/174.17 |
| 4,568,555 | 2/1986 | Spanier | 426/582 |

OTHER PUBLICATIONS

Flick, Ernest W. "Car Wash Compounds and Shampoos," In: *Household, Automotive, and Industrial Chemical Formulations* (New Jersey, Noyes Publications, 1984), pp. 292–299.

*Primary Examiner*—Paul Lieberman
*Assistant Examiner*—Kathleen Markowski

[57] ABSTRACT

A liquid cleaning composition efficient for washing automobile bodies and windows is disclosed. A preferred embodiment of the composition contains about 77% raw potato juice, about 20% 190 proof denatured alcohol, about 1% sodium stearyl fumerate and about 2% non-ionic surfactant.

1 Claim, No Drawings

ORGANIC CAR WASH CONTAINING RAW POTATO JUICE

DISCLOSURE OF THE INVENTION

The present invention provides a car washing liquid compound, which when applied to a car's body and glass windows with the aid of a soft cloth or sponge will remove dirt efficiently as the whole car is thoroughly rinsed with water immediately after applying the compound.

The compound is dispensed from a non-aerosol container by either hand-pumping on a cloth or sponge and then applying to the car, or directly spraying on the car surfaces and then applying it with a cloth or sponge; or, by pouring the compound from the container to the cloth or sponge.

While the foregoing illustrates a preferred mode and purpose for the use of the present invention, other uses of the basic concepts of the present invention can also be practiced.

DESCRIPTION OF THE PREFERRED EMBODIMENT AND FORMULATION

In its preferred execution, the present invention provides an organically based product which is composed of the following:

| INGREDIENTS | RATIO |
|---|---|
| Raw Potato Juice | 77% |
| Denatured alcohol 190 Proof | 20% |
| Sodium Stearyl Fumerate | 1% |
| Non-Ionic Surfactant | 2% |
| TOTAL | 100% |

It can also be appreciated that the present invention offers a relatively more effective agent for washing a car because of its largely organic composition.

Of course, it will be readily recognized that the product of this invention can be used for a variety of dirt-removal activities ranging from all types of glass surfaces to painted metal surfaces other than those found in cars. In its broadest aspect, this versatility clearly distinguishes the present invention from the rest of cleansing agents.

I claim:

1. A composition for washing automobile bodies and windows comprising about 77% raw potato juice, above 20% 190 proof denatured alcohol, about 1% sodium stearyl fumerate and about 2% non-ionic surfactant.

* * * * *